US012672692B2

(12) United States Patent
Altshuler et al.

(10) Patent No.: US 12,672,692 B2
(45) Date of Patent: Jul. 7, 2026

(54) SKATE SYSTEM

(71) Applicants: Edward Altshuler, Dacono, CO (US); David Cruikshank, Delafield, WI (US)

(72) Inventors: Edward Altshuler, Dacono, CO (US); David Cruikshank, Delafield, WI (US)

( * ) Notice: Subject to any disclaimer, the term of this patent is extended or adjusted under 35 U.S.C. 154(b) by 0 days.

(21) Appl. No.: 19/171,244

(22) Filed: Apr. 5, 2025

(65) Prior Publication Data

US 2025/0331600 A1 Oct. 30, 2025

Related U.S. Application Data

(63) Continuation-in-part of application No. 18/131,421, filed on Apr. 6, 2023.

(60) Provisional application No. 63/638,382, filed on Apr. 24, 2024.

(51) Int. Cl.
*A43B 5/16* (2006.01)
*A63C 1/42* (2006.01)

(52) U.S. Cl.
CPC ..... *A43B 5/1683* (2013.01); *A63C 1/42* (2013.01)

(58) Field of Classification Search
CPC ... A43B 5/1683; A43B 5/1625; A43B 5/1641; A43B 5/165; A43B 5/1658; A43B 5/1666; A43B 5/1691; A43B 5/0486; A43B 5/049; A63C 1/42
See application file for complete search history.

(56) References Cited

U.S. PATENT DOCUMENTS

| | | | | |
|---|---|---|---|---|
| 3,339,935 | A | 9/1967 | Weisman | |
| 6,669,210 | B2 | 12/2003 | Chen | |
| 7,392,990 | B2 | 7/2008 | Bussiere | |
| 7,533,479 | B2 | 5/2009 | Labonte | |
| 7,562,881 | B2 | 7/2009 | Crowder | |
| 8,505,217 | B2 | 8/2013 | Stewart | |
| 11,122,855 | B2 | 9/2021 | Horne et al. | |
| 11,406,156 | B2 | 8/2022 | Champagne et al. | |
| 11,554,310 | B2 | 1/2023 | Dubois et al. | |
| 11,825,908 | B2 | 11/2023 | Seguin et al. | |
| 12,048,350 | B2 | 7/2024 | Alexander et al. | |
| 2005/0081408 | A1* | 4/2005 | Chaigne | A43B 5/1625 36/117.6 |
| 2021/0206130 | A1* | 7/2021 | Labonte | A43D 3/027 |
| 2021/0401109 | A1* | 12/2021 | Labonte | A63C 1/42 |
| 2024/0325862 | A1* | 10/2024 | Krick | A63C 1/42 |

* cited by examiner

*Primary Examiner* — Khoa D Huynh
*Assistant Examiner* — Erick I Lopez
(74) *Attorney, Agent, or Firm* — Kenneth Altshuler

(57) ABSTRACT

An ice skate boot as described herein can include a boot that is generally defined by an outer boot shell that includes a boot sole, a heal region, a toe box, and sidewalls between the toe box and the heal region. The sidewalls extend from the boot sole to a boot collar and tongue gap. Each of the sidewalls generally comprises an impact absorbing layer, a thermo-moldable layer and a foot contact layer, wherein the foot contact layer configured to interface a human foot. The impact absorbing layer is interposed between the outer boot shell and the thermo-moldable layer, the thermo-moldable layer is interposed between the impact absorbing layer and the foot contact layer. The thermo-moldable layer and the impact absorbing layer are incorporated in the heal region and extending at least to the toe box.

20 Claims, 20 Drawing Sheets

SKATE SYSTEM

CROSS-REFERENCE TO RELATED APPLICATIONS

This application claims priority to and the benefit of U.S. Patent Provisional Application No. 63/638,382 entitled: Skate System, filed on Apr. 24, 2024, the entire disclosure is hereby incorporated by reference.

The clean version of the amended specification replaces all prior versions of the specification. The amendments made herein to the specification are proper and add no new matter.

BACKGROUND OF THE INVENTION

Field of the Invention

The present invention relates generally to an ice-skate runner assembly.

DESCRIPTION OF RELATED ART

A fundamental interest in the human experience is sport. We will spend our wealth and resources on whatever sport/s piques our interest vying for the latest innovation that could possibly give us a competitive edge. The progression of sport innovations is easily recognized by sports equipment related filings over the years at the United States Patent and Trademark Office. In the field of hockey for example, hockey skates are generally comprised of a boot and steel blade bolted or fixed to the boot sole. Modern hockey skates typically include innovations such as a hard plastic shell that accepts a portion of the skate blade whereby the shell is bolted to the skate blade and may further act as an interface and attachment medium to the boot sole. Accordingly, the current state of hockey skate technology leaves open lots of problems yet to be solved in the march for the best hockey skate for a given purpose defined by the game.

It is to innovations related to improving hockey blades and runners that the subject matter disclosed herein is generally directed.

SUMMARY OF THE INVENTION

The present invention generally relates to a multi-layered boot arrangement that connects an ice-skate.

Accordingly, certain embodiments of the present invention envision an ice skate boot, as shown in FIGS. 6A-6E, envisions a boot that is generally defined by an outer boot shell that includes a boot sole, a heel region, a toe box, and sidewalls between the toe box and the heel region. Each of the sidewalls extends from the boot sole to a boot collar and tongue gap. Each of the sidewalls generally comprises an impact absorbing layer, a thermo-moldable layer and a foot contact layer, wherein the foot contact layer configured to interface a human foot. The impact absorbing layer is interposed between the outer boot shell and the thermo-moldable layer, the thermo-moldable layer is interposed between the impact absorbing layer and the foot contact layer. The thermo-moldable layer and the impact absorbing layer are incorporated in the heel region and extending at least to the toe box.

Another embodiment of the present invention, as shown in FIGS. 6A-6E, envisions a reinforced ice skate boot generally comprised of an outer boot shell that includes a boot sole, a heel region, a toe box, and sidewalls between the toe box and the heel region. The sidewalls can extend from the boot sole to a boot collar and tongue gap. Each of the sidewalls comprises an additive manufactured layer, an impact absorbing layer, a thermo-moldable layer and a foot contact layer, wherein the foot contact layer is configured to interface a human foot. The additive manufactured layer is interposed between the outer boot shell and the impact absorbing layer. The thermo-moldable layer is interposed between the impact absorbing layer and the foot contact layer. The thermo-moldable layer and the impact absorbing layer are incorporated in the heel region and extend at least to the toe box.

Yet another embodiment of the present invention, as shown in FIGS. 6A-6E, envisions a multilayer ice skate boot comprising an outer boot shell that includes a boot sole, a heel region, a toe box, and sidewalls between the toe box and the heel region. The sidewalls extend from the boot sole to a boot collar and tongue gap. Each of the sidewalls comprises an additive manufactured layer, an impact absorbing layer, a thermo-moldable layer and a foot contact layer, wherein the foot contact layer is configured to interface a human foot. The additive manufactured layer is interposed between the outer boot shell and the impact absorbing layer. The thermo-moldable layer is interposed between the impact absorbing layer and the foot contact layer. The thermo-moldable layer and the impact absorbing layer are incorporated in the heel region and extend at least to the toe box.

DETAILED DESCRIPTION

Figure 1A:
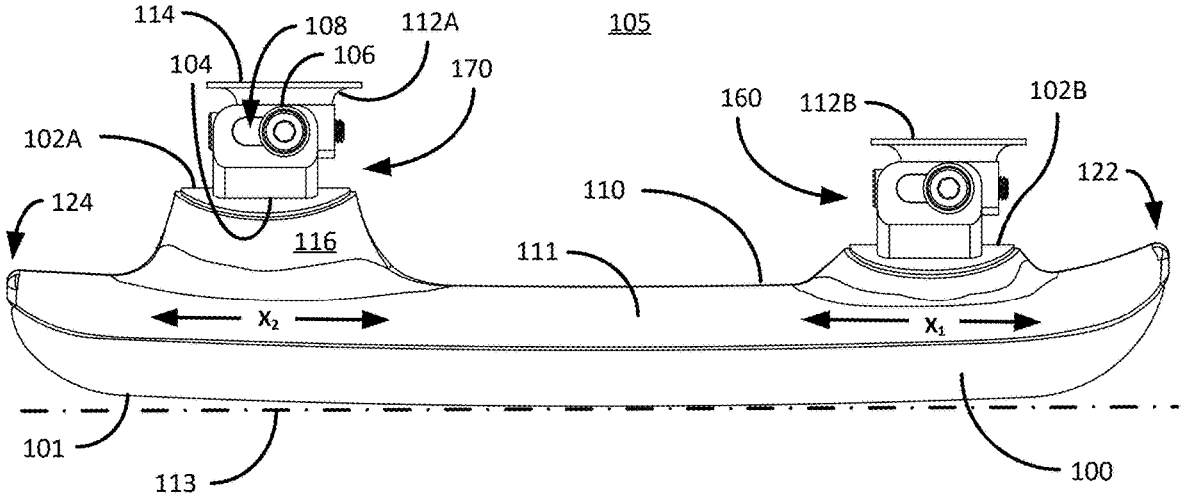
FIGS. 1A-1C are line drawings that illustratively depict an overview of a multi-degree of freedom adjustment post arrangement consistent with embodiments of the present invention.

Initially, this disclosure is by way of example only, not by limitation. Thus, although the instrumentalities described herein are for the convenience of explanation, shown and described with respect to exemplary embodiments, it will be appreciated that the principles herein may be applied equally in other similar configurations involving the subject matter directed to the field of the invention. The phrases "in one embodiment", "according to one embodiment", and the like, generally mean the particular feature, structure, or characteristic following the phrase, is included in at least one embodiment of the present invention and may be included in more than one embodiment of the present invention. Importantly, such phases do not necessarily refer to the same embodiment. If the specification states a component or feature "may", "can", "could", or "might" be included or have a characteristic, that particular component or feature is not required to be included or have the characteristic. As used herein, the terms "having", "have", "including" and "include" are considered open language and are synonymous with the term "comprising". Furthermore, as used herein, the term "essentially" is meant to stress that a characteristic of something is to be interpreted within acceptable tolerance margins known to those skilled in the art in keeping with typical normal world tolerance, which is analogous with "more or less." For example, essentially flat, essentially straight, essentially on time, etc. all indicate that these characteristics are not capable of being perfect within the sense of their limits. Accordingly, if there is no specific +/−value assigned to "essentially", then assume essentially means to be within +/−2.5% of exact. The term "connected to" as used herein is to be interpreted as a first element physically linked or attached to a second element and not as a "means for attaching" as in a "means plus function". In fact, unless a term expressly uses "means for" followed by the gerund form of a verb, that term shall not be interpreted under 35 U.S.C. § 112(f). In what follows, similar or identical structures may be identified using identical callouts.

With respect to the drawings, it is noted that the figures are not necessarily drawn to scale and are diagrammatic in nature to illustrate features of interest. Descriptive terminology such as, for example, upper/lower, top/bottom, horizontal/vertical, left/right and the like, may be adopted with respect to the various views or conventions provided in the figures as generally understood by an onlooker for purposes of enhancing the reader's understanding and is in no way intended to be limiting. All embodiments described herein are submitted to be operational irrespective of any overall physical orientation unless specifically described otherwise, such as elements that rely on gravity to operate, for example.

Described herein are various ice skate boot configurations, which can include a boot that is generally defined by an outer boot shell that includes a boot sole, a heel region, a toe box, and sidewalls between the toe box and the heel region. The sidewalls extend from the boot sole to a boot collar and tongue gap. Each of the sidewalls generally comprises an impact absorbing layer, a thermo-moldable layer and a foot contact layer, wherein the foot contact layer configured to interface a human foot. The impact absorbing layer is interposed between the outer boot shell and the thermo-moldable layer, the thermo-moldable layer is interposed between the impact absorbing layer and the foot contact layer. The thermo-moldable layer and the impact absorbing layer are incorporated in the heel region and extending at least to the toe box.

Figure 1B:
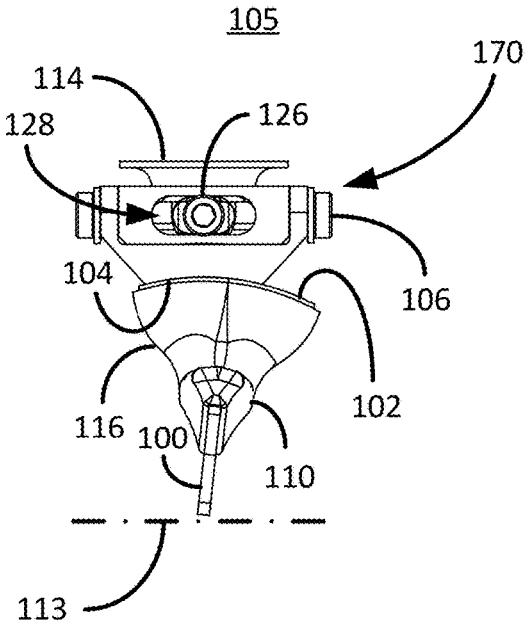
Figure 1C:
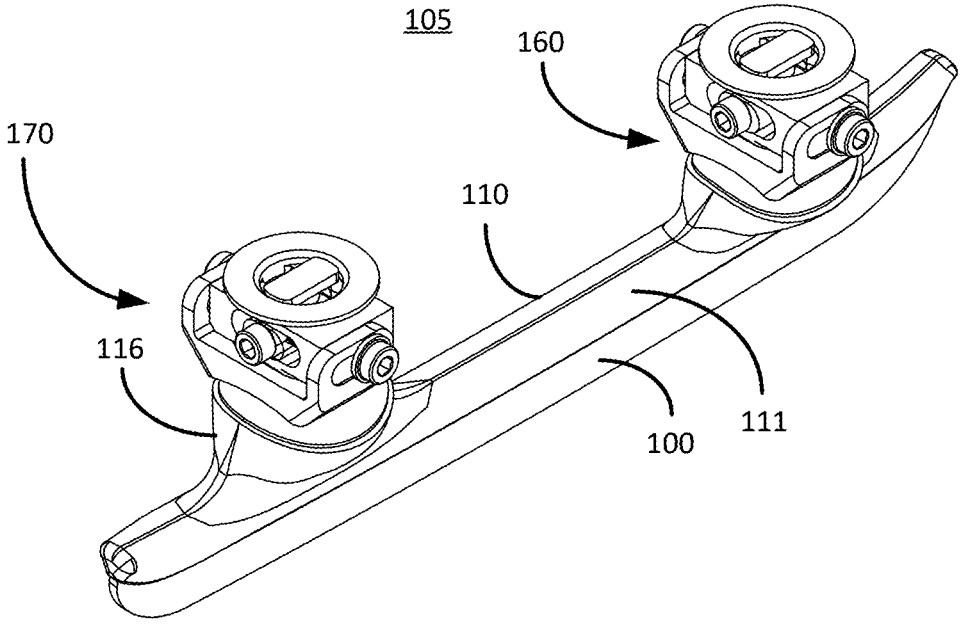

FIGS. 1A-1C are line drawings that illustratively depict an overview of a multi-degree of freedom adjustment post arrangement consistent with embodiments of the present invention. The multi-degree of freedom adjustment post arrangement can slide fore and aft, side-to-side (left and right) and pronate/supinate direction (as viewed from the rear of the runner 124). FIG. 1A illustratively depicts a side view line drawing of a skate assembly 105 that includes the skate blade 100 and skate overmold 111 comprising front and rear multi-degree of freedom arrangements 160 and 170. The front and rear multi-degree of freedom arrangements 160 and 170 essentially take the place of a static ice skate post that traditionally connects a skate blade to a skate boot sole. The front and rear multi-degree of freedom arrangements 160 and 170 connects a skate blade to a skate boot sole via the multi-degree of freedom arrangement's top surface 114. Hence, the front and rear multi-degree of freedom arrangements 160 and 170 can also be considered front and rear multi-degree of freedom skate posts 160 and 170. As shown in FIG. 1A, a rear mount 112A in the rear multi-degree of freedom arrangement 170 is adjustably connected with the rear mounting surface 102 of the rear runner extension 116 via the rear multi-degree of freedom arrangement mounting plate 104, which can be moved in the $X_2$ (fore/aft) direction via a locking fore/aft nut 106 and fore/aft slot 108. In this embodiment, the fore/aft nut 106 is connected to the rear mount 112A, which when loosened slides inside of the fore/aft slot 108. Then the fore/aft nut 106 is tightened locking the rear mount 112A in the set fore/aft position $X_2$. Though the fore/aft slot 108 and fore/aft nut 106 arrangement is described, optional embodiments envision a cam system or something else that permits a fore/aft nut (or pin) 106 to slidingly engage a fore/aft slot 108. The front skate post 160 can move in the $X_1$ (fore/aft) direction in the same way as described in conjunction with the rear skate post 170. As further shown, the skate blade 100 and skate overmold 111 are shown in addition to the runner front 122. The blade edge 101 is shown in contact with the surface of ice 113, which also defines a horizontal plane from which elements of the skate assembly 105 are oriented. Certain embodiments envision the rear mount 112A and front mount 112B being cast into the boot sole or locking into an anchor point on the sole. Certain embodiments also contemplate that once the fore and aft locks 106 and 108 are tightened down, cams associated with those parts 106/108 lock the skate runner 110 into place from moving fore/aft $X_2$ (or sided to side).

FIG. 1B is a rear-view perspective line drawing of the multi-degree of freedom adjustment post arrangement showing the rear skate post 170 to illustrate the pronate/supinate relationship of the skate post 170 relative to the rear runner extension 116, the skate blade 100 and the skate overmold 111. As shown here, the rear mounting plate 104 is slidingly engaged in a pronate/supinate relationship with the rear mounting surface 102 of the rear runner extension 116. The pronate/supinate adjustability can come from loosening a rear pronate/supinate nut 117 internal to the skate post 170, as shown in FIG. 1J. Some embodiments contemplate the skate post 170 being moved 5 degrees in either direction from the centerline, however other angles are considered without departing from the scope and spirit of the present invention. The side-to-side nut 126 is in the center of the side-to-side slot 128, i.e., in a neutral position. The rear side-to-side nut 126 and side-to-side slot 128 can include the same embodiments presented with the fore/aft nut/slot 106 and 108 relationship, which can include cams and other mechanical designs that take advantage of a slot and locking nut relationship.

FIG. 1C is an isometric view of the skate assembly 105 showing the relationship of the elements described in FIGS.

1A and 1B of the front and rear multi-degree of freedom skate posts 160 and 170 relative to the skate blade 100 and skate overmold 111.

Figures 1D, 1E, 1F:
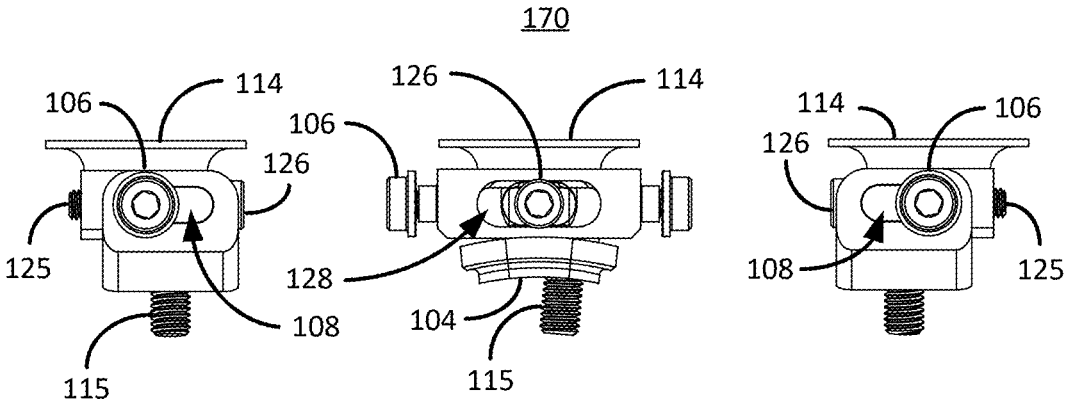
FIG. 1D-1H are various line drawing perspectives showing the specific parts of a rear multi-degree of freedom skate post, which in certain embodiments is identical to the front multi-degree of freedom skate post of FIG. 1A.

FIG. 1D-1H are various line drawing perspectives showing the specific parts of a rear multi-degree of freedom skate post 170, which in certain embodiments is identical to the front multi-degree of freedom skate post 160 of FIG. 1A. FIGS. 1D-1F are a right-side, front-side and left-side view of a rear multi-degree of freedom skate post 170. FIG. 1D is the right-side view of skate post 170 depicting the locking fore/aft nut 106 to the far left in the fore/aft slot 108. The rear side-to-side nut 126 depicts its threaded bolt end 125 extending through the skate post 170. The multi-degree of freedom arrangement's top surface 114 is shown for reference. The pronate/supinate bolt 115 also serves as a skate post to runner extension bolt to secure the skate post 170 to the skate runner 110 via the runner extension 116. FIG. 1E is a front side view of the skate post 170 depicting the rear side-to-side nut 126 in the center of the side-to-side slot 128. As is further shown, the pronate/supinate bolt 115 is shown to the right, which puts the skate runner 110 at an angle as shown in FIG. 1B. FIG. 1F is the left side view of the skate post 170 depicting the mirror image of FIG. 1D.

Figure 1G:
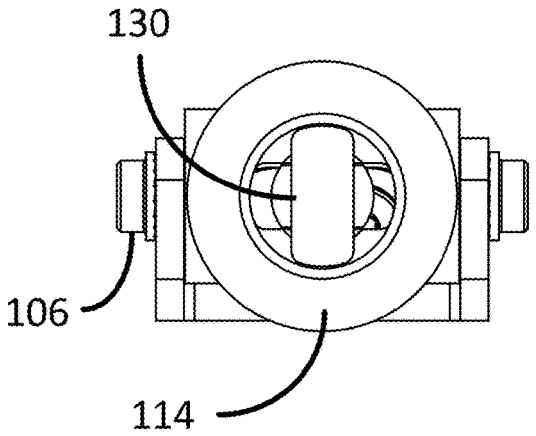

FIG. 1G is a top view of the rear multi-degree of freedom skate post 170 depicting a locking bar 130 that keys into the sole of the skate boot to attach the skate post 170 to the boot.

Figure 1H:
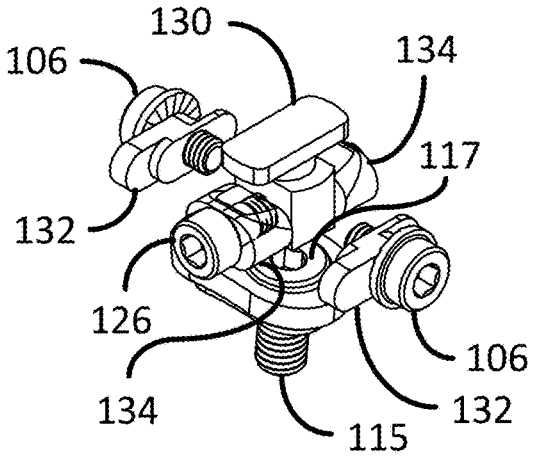

FIG. 1H is an isometric exploded view of the rear multi-degree of freedom skate post 170. As shown, the fore/aft bolt system 106 includes locking spacers 132 to lock in the fore/aft position. The side-to-side bolt locks in place in the slot 128 via locking cams 134. The pronate/supinate bolt head 117 is shown in this image with the threaded pronate/supinate bolt 115 extending out the bottom. The locking bar 130 is also shown.

Figure 1I:
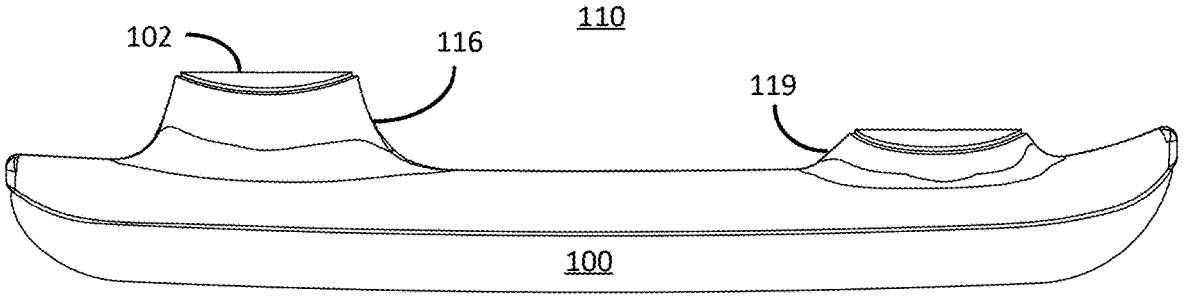
FIGS. 1I-K are line drawings depicting the skate runner that cooperates with the front and rear multi-degree of freedom arrangements.
Figure 1J:
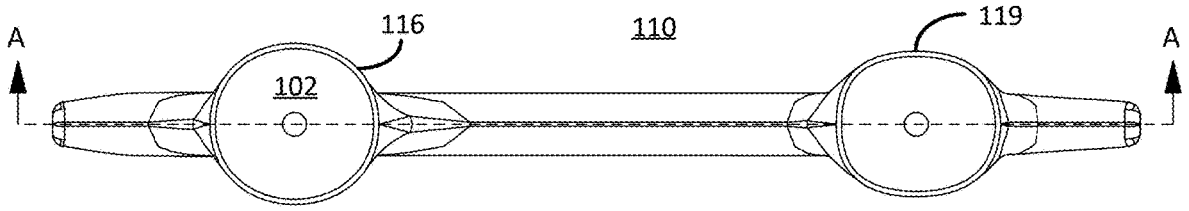
Figure 1K:
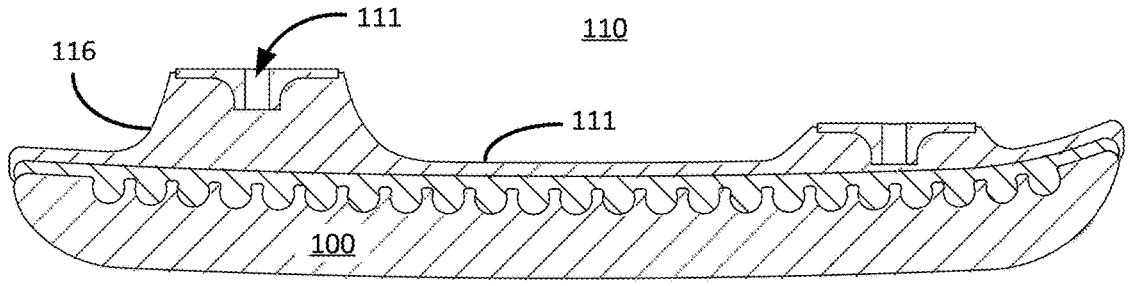

FIGS. 1I-K are line drawings depicting the skate runner 110, which is arranged and configured to cooperate with the front and rear multi-degree of freedom arrangements 160 and 170. FIG. 1I is a side view of the runner 110 showing the front runner extension 119 and the rear runner extension 116. FIG. 1J is a top view of the skate runner 110 with a cut-line A-A extending along its center axis. As is shown in this embodiment, the rear mounting surface 102A is a different shape than the front mounting surface 102B. FIG. 1K is a cross-section view of the skate runner 110 depicting the blade 100 shape and the runner overmold 111.

Figure 2A:
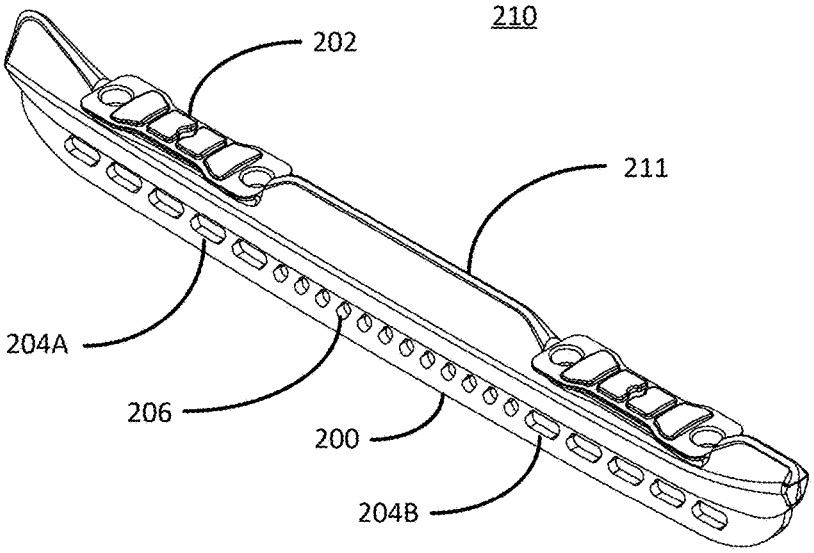
FIGS. 2A-2C are line drawings depicting a variable stiffness skate blade consistent with embodiments of the present invention.
Figure 2B:
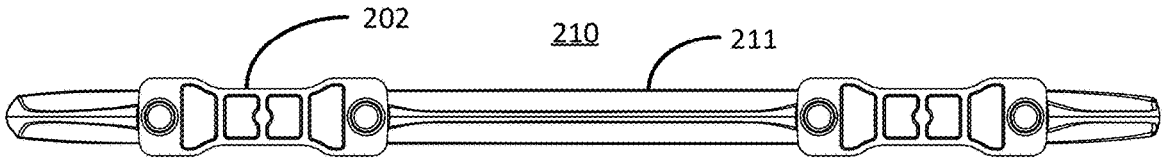
Figure 2C:
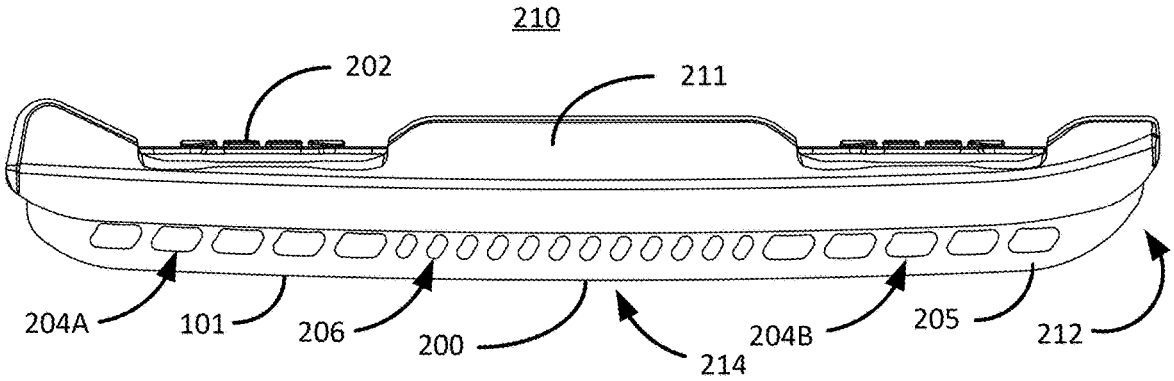

FIGS. 2A-2C are line drawings depicting a variable stiffness skate blade consistent with embodiments of the present invention. FIG. 2A in view of FIG. 2C is an isometric line drawing of the variable stiffness blade embodiment 200 that is shown partially embedded in a skate overmold 211. The variable stiffness blade 200 and skate overmold 211 generally comprise the skate runner 210. As shown, the variable stiffness blade 200 has non-uniform perforations 204A, 204B and 206 along the blade profile 205. The non-uniform perforations 204A, 204B and 206 alter the bending and torsional moment of inertia along the blade 200 compared to a blade that has no perforations. The elongated perforation 204A and 204B allow more flex in the blade 200 than the small perforations 206. The bending and torsional moment of inertia of the skate blade 200 is tuned by altering the number of perforations, the spacing between the perforations, the size of the perforation and the shape of the perforations. Accordingly, in this configuration, the blade ends 212A and 212B are more flexible than the blade center 214 when contacting the ice. The non-uniform perforations 204A, 204B and 206 shown here are simply an example of an arrangement of perforations tuned for a specific skater's style and weight. Other embodiments contemplate putting the perforations 204A, 204B and 206 at different heights along the blade 200 with some perforations being closer to the blade edge 101 than others and/or closer or further away from the blade edge 101. In an optional embodiment, instead of perforations or in addition to perforations, the skate blade can have thinner regions, which too will change the stiffness of the blade. The thinner regions can be lines, patches, or other shapes and, like the perforations 204A, 204B and 206, can be customized to the skater. FIG. 2B is a top view of the skate runner 210 showing the overmold 211 and the mounting surfaces 202. FIG. 2C is a side view of the skate runner 210.

Figure 3A:
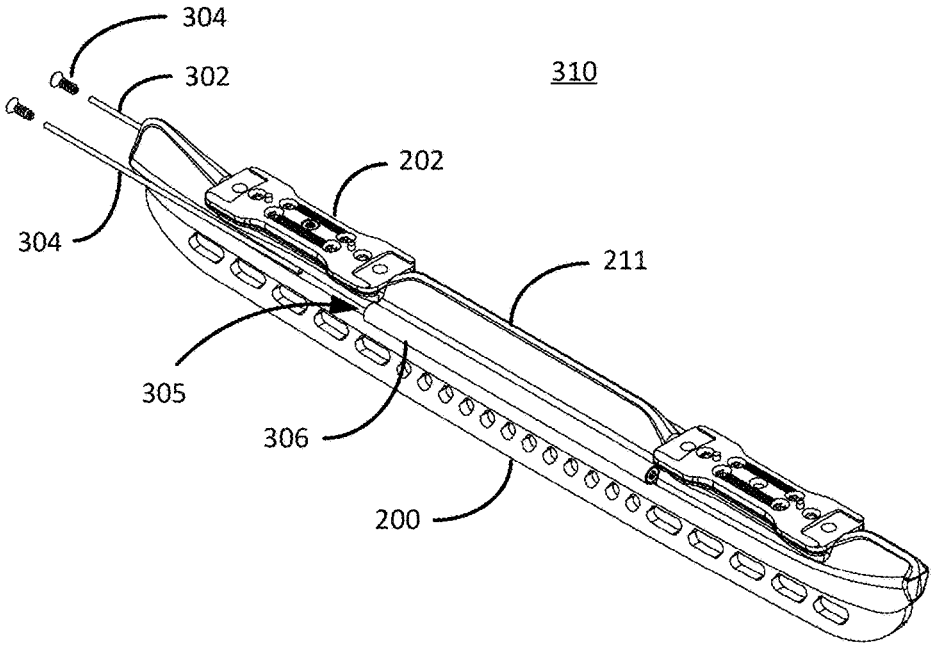
FIGS. 3A-3D are line drawings of a skate runner with stiffening rods consistent with embodiments of the present invention.
Figure 3B:
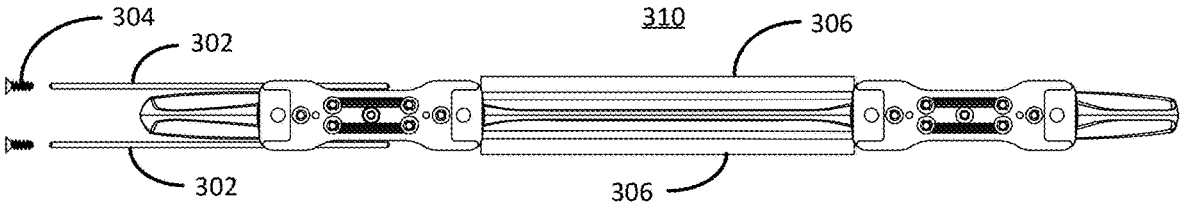
Figure 3C:
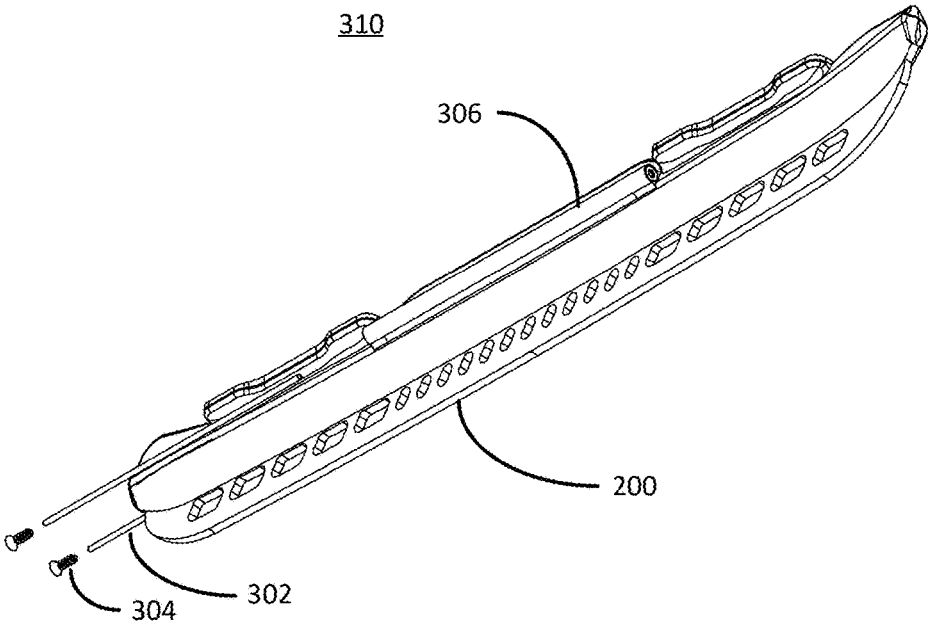
Figure 3D:
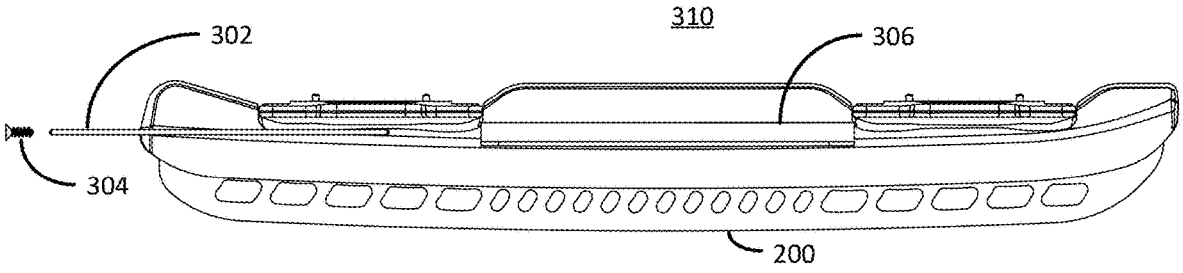

FIGS. 3A-3D are line drawings of a skate runner with stiffening rods consistent with embodiments of the present invention. FIG. 3A is a top isometric drawing that illustratively depicts an exploded view of a pair of stiffening rods 302 extending from the back side of the skate runner 310. The stiffening rods 302 will change the moment of inertia of the skate runner 110 and therefore the feel of the blade 100 on the ice. In this embodiment, the pair of stiffening rods 302 are accompanied by a pair of retaining bolts 304 that lock the stiffening rods 302 inside of corresponding rod receiving sleeves 306. The receiving sleeves 306 are located on either side of the neutral/central axis of the skate runner 310. The further apart the receiving sleeves 306 are from the neutral axis, the greater the moment of inertia. The vertical location of the receiving sleeves 306 from the blade 200 can be altered in some embodiments. The stiffening rods 302 can be inserted into the corresponding rod receiving sleeves 306 via a sleeve receiving port 305 in the fore/aft axis of the skate runner 310. When the skate runner 310 is devoid of the pair of stiffening rods 302, the skate blade 200 is more flexible on the ice. One or both stiffening rods 302 can be used. The rod receiving sleeves 306 are constructed with the overmold 211. The rod receiving sleeves 306 can be part of the overmold 211 or connected to the overmold 211. The stiffening rods 302 can be used in conjunction with the variable stiffness blade 200 or independent thereof. Customizing the skate rods can be done to accommodate the needs of the skater. For example, certain embodiments contemplate using different thickness rods, different shaped rods, different stiffness rods, different modulus rods, rods with different materials, etc. FIG. 3B is a top-down exploded view of the skate runner 310 with stiffening rods 302 and receiving sleeves 306. FIG. 3C is an isometric view looing upward at the exploded skate runner 310 with stiffening rods 302 and receiving sleeves 306. FIG. 3D is a side view of the exploded skate runner 310 showing the stiffening rod 302, rod retaining bolt 304 and receiving sleeve 306.

Figure 4A:
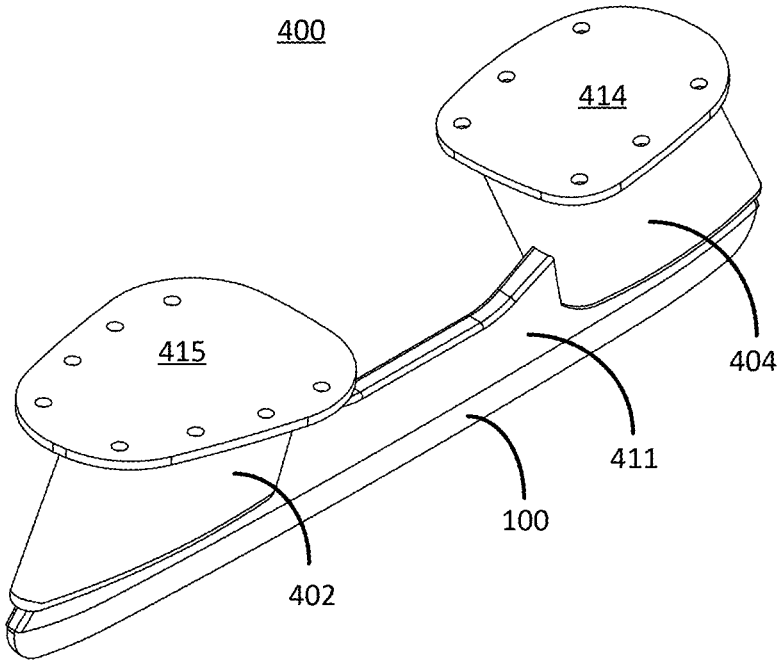
FIGS. 4A-4F are line drawings of a single riser assembly for skates consistent with embodiments of the present invention.
Figure 4B:
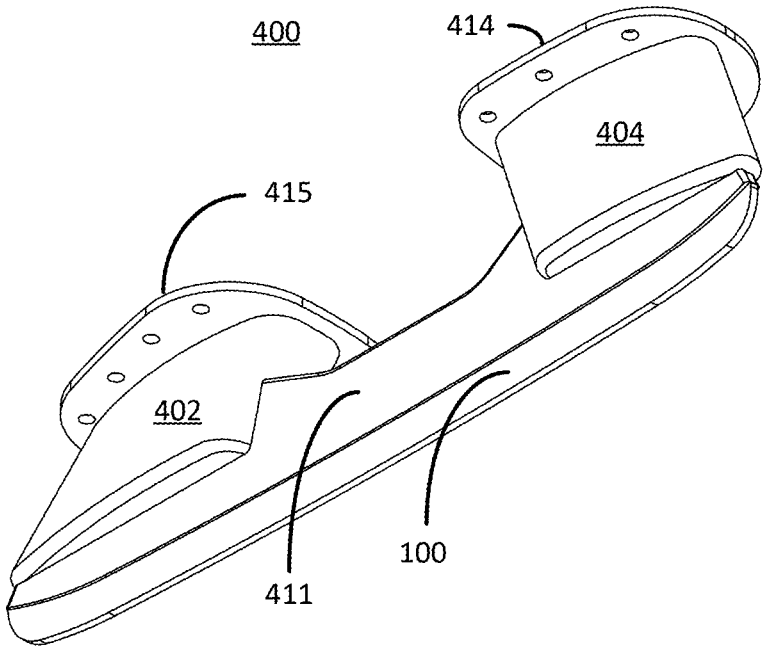
Figure 4C:
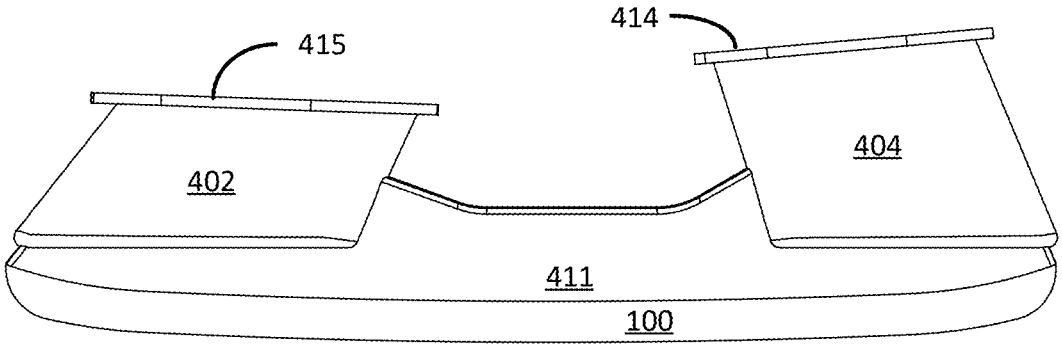
Figure 4D:
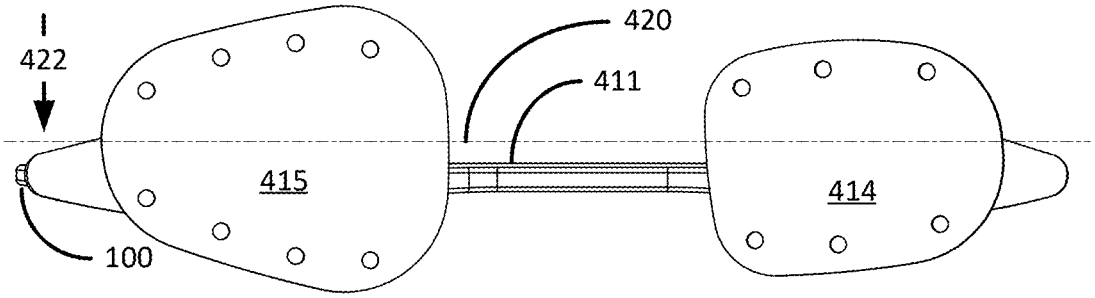
Figure 4E:
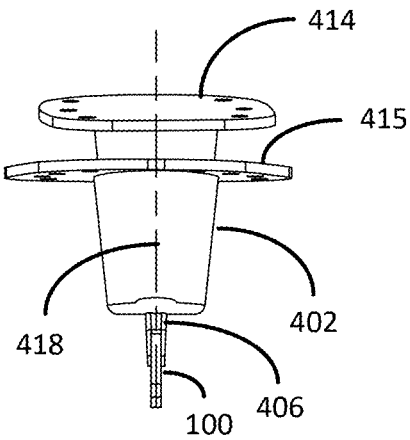
Figure 4F:
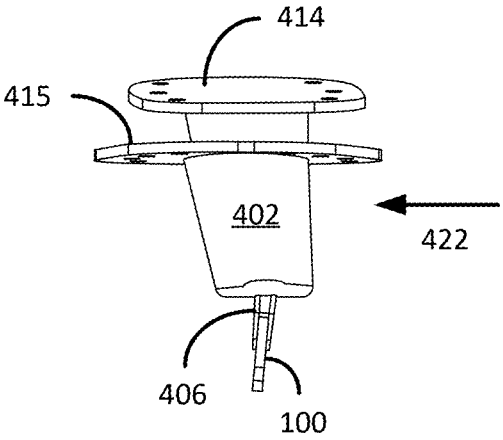

FIGS. 4A-4F are line drawings of a single/unitary riser assembly for skates consistent with embodiments of the present invention. FIG. 4A is an isometric drawing of a top-down perspective on a single riser assembly 400 having built-in blade offsets. Certain embodiments contemplate the single riser assembly 400 being plastic (i.e., PET, HDPE, PVC, LDPE, PP, etc.), fiberglass, carbon fiber, etc., and molded or 3-D printed into a single/unitary part or a composite that is fixedly connected together. As shown, there is a single mounting structure that comprises the front and back risers 402 and 404, the center web 411 and optionally the blade 100. The risers 402 and 404 each comprise a mounting surface 415 and 414 that connects the single riser assembly 400 to the sole of a skate. FIG. 4B is an isometric drawing of a bottom-up perspective of the single riser assembly 400 having built-in blade offsets. FIG. 4C is a side view line drawing of the single riser assembly 400 depicting the elements described above. FIG. 4D depicts the offset position of the single riser assembly 400 as viewed from the assembly's top with the mounting surfaces 415 and 414 prominently displayed. As shown here, the center web 411 and skate blade 100 is offset from the centerline 420 in the direction of the arrow 422. FIG. 4F shows the front and back risers 402 and 404 shifted to the left in the direction of the arrow 422. FIG. 4E shows a variation of the single riser assembly 400 with no offset, as shown by the mounting surfaces 415 and 414 relative to the centerline 418. The single riser assembly 400 has an added benefit of attaching to a skate boot sole in the same fashion as an existing skate blade holder for a standard manufactured skate boot. In this embodiment, a blade mounting structure/sleeve 406 is added to interface with the plastic holder 402, 404 and 411. The single riser assembly 400 is envisioned to be a manufactured with an offset that is not adjustable but can have a fore and aft offset, a side-to-side offset, a pronate/supinate offset and a height offset from a standard height. In certain embodiments, the single riser assembly 400 can be ordered by an athlete that knows the amount of offsets that works best for them, such as from testing their performance with an adjustable offset system.

Figure 5A:
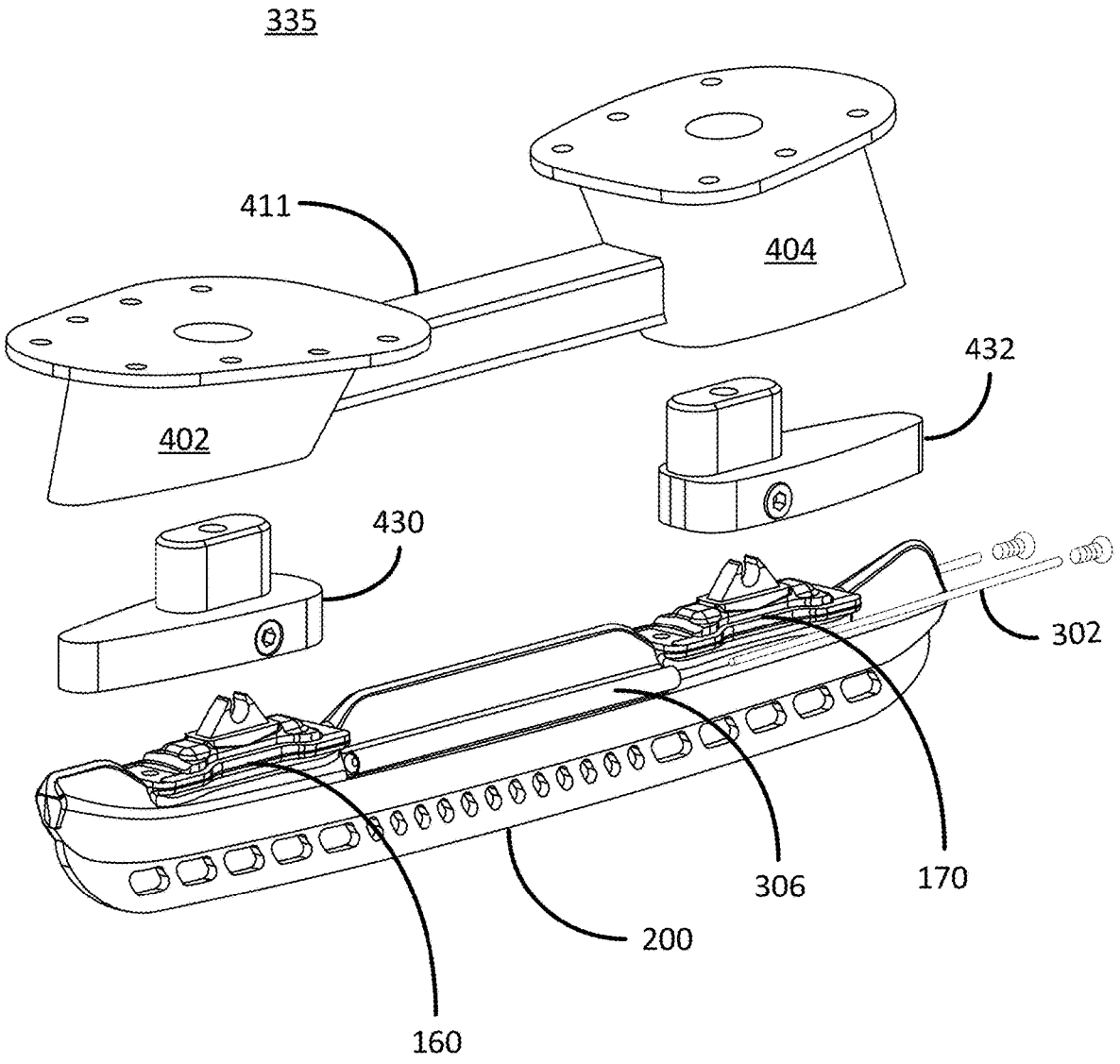
FIGS. 5A-5F illustratively depict a highbred arrangement pulling in a number of elements from the embodiments shown in the preceding figures.
Figure 5B:
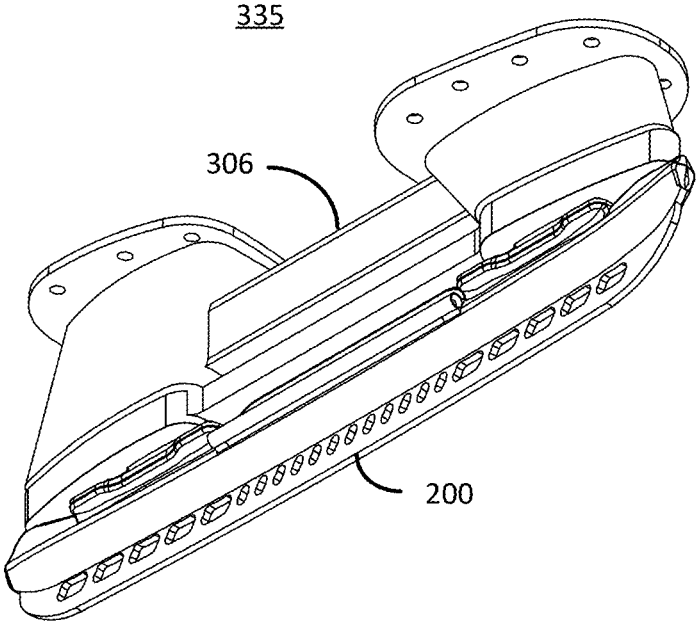
Figure 5C:
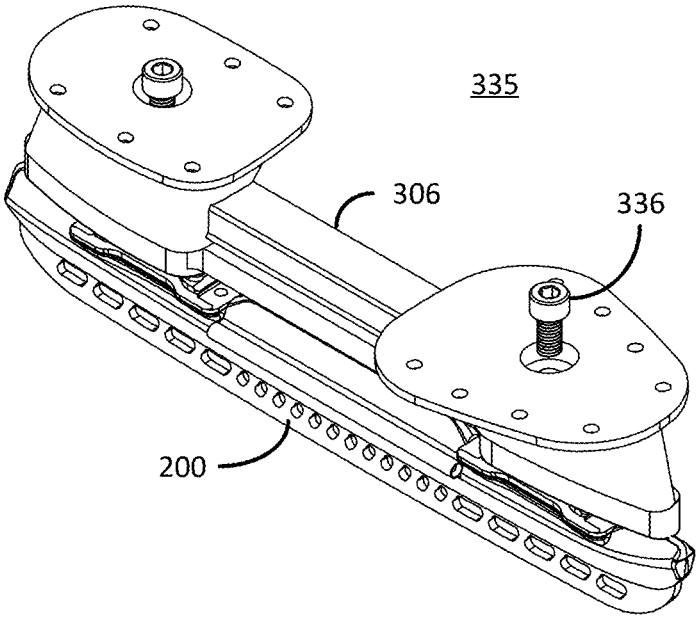
Figure 5D:
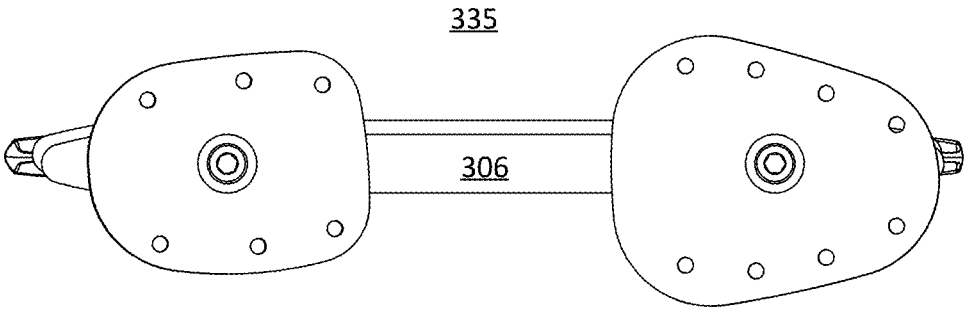
Figure 5E:
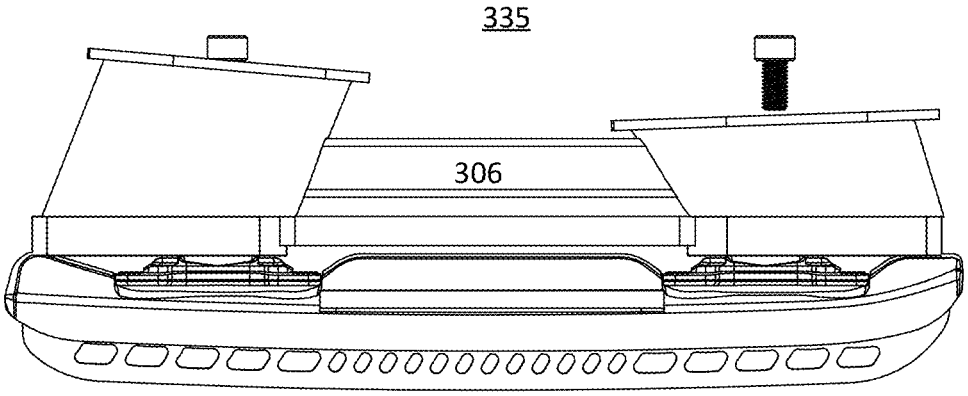
Figure 5F:
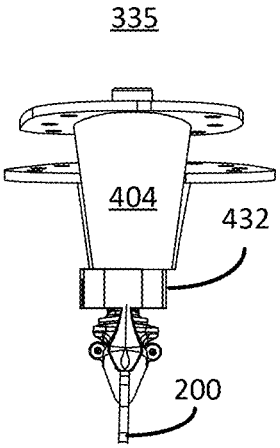

FIGS. 5A-5F illustratively depict a highbred arrangement 335 combining several elements from the embodiments shown in the preceding figures. As shown, FIG. 5A depicts the highbred arrangement 335 comprising a front coupling stay 430 and a rear coupling stay 432 to join or otherwise couple the front and rear multi-degree of freedom arrangements 160 and 170. Note that the variable stiffness blade embodiment 200 and the stiffening rods 302 and the rod receiving sleeves 306 are also integrated in this embodiment 335. FIGS. 5B-5F depict various views of the highbred arrangement 335 with special attention to FIG. 5B, which shows the boot attachment bolts 336 and FIG. 5F, which shows a side-to-side offset of the variable stiffness blade 200.

Figure 6A:
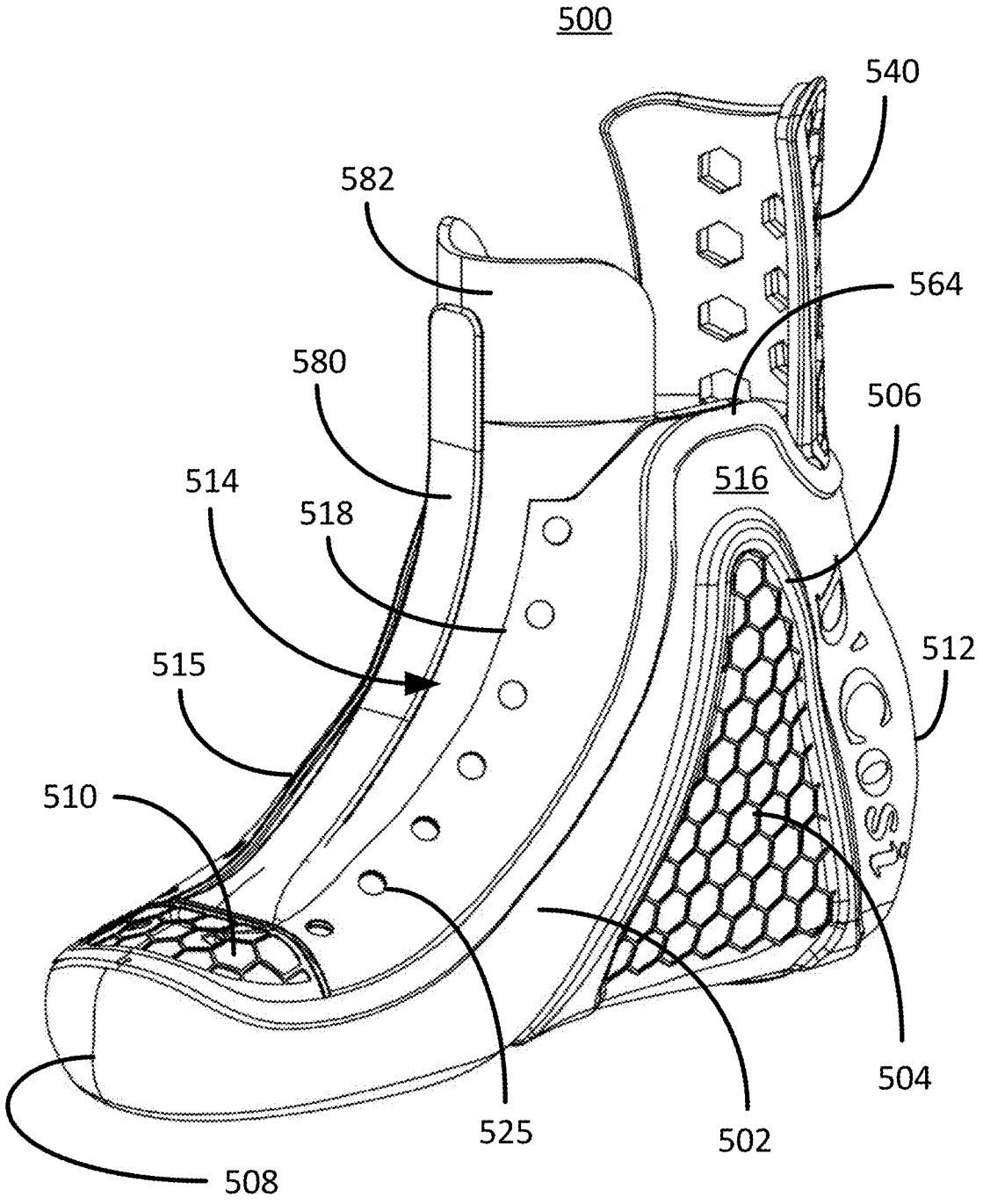
FIGS. 6A-6D are various views of a skate boot assembly consistent with embodiments of the present invention.
Figure 6B:
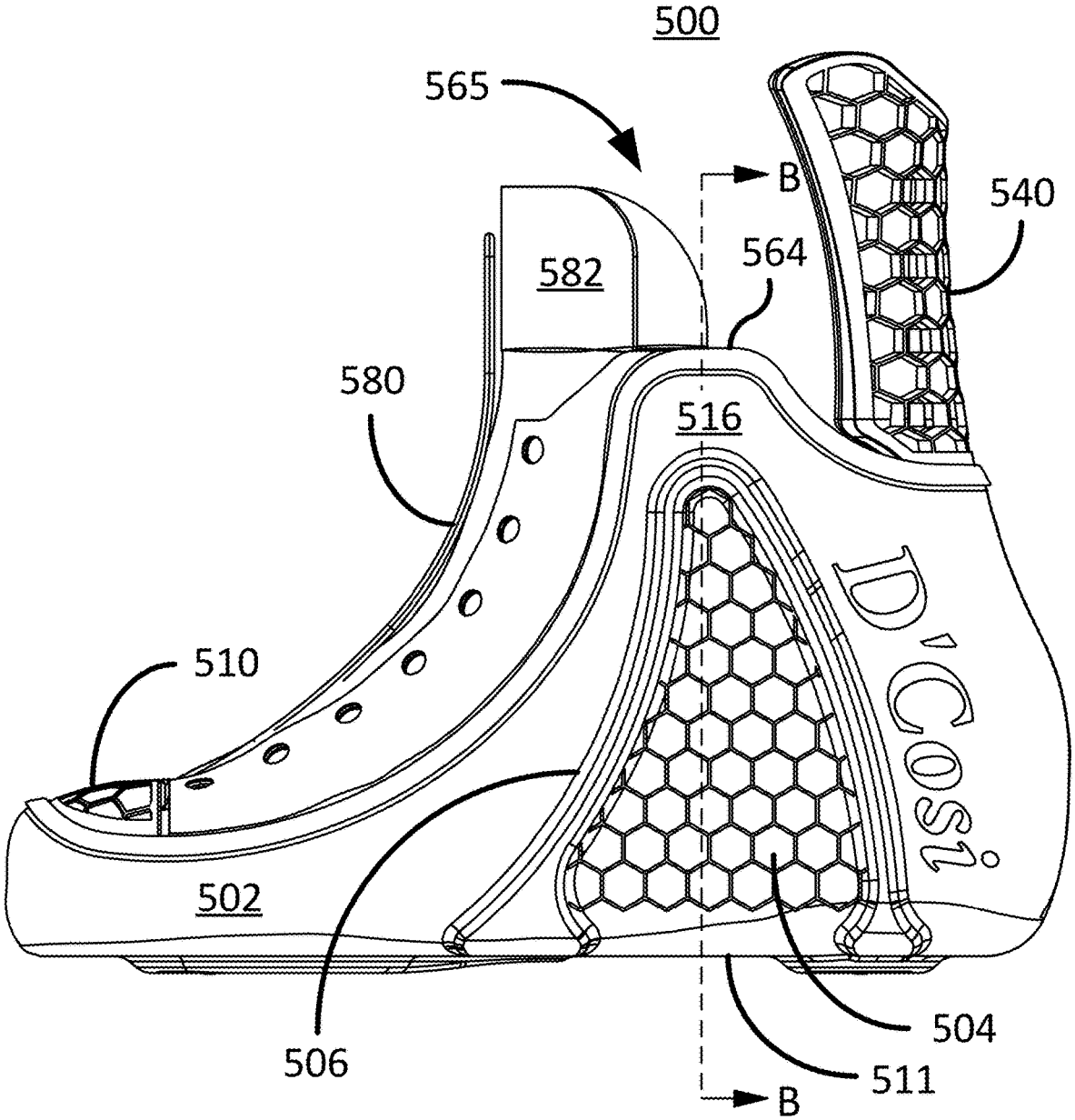
Figure 6C:
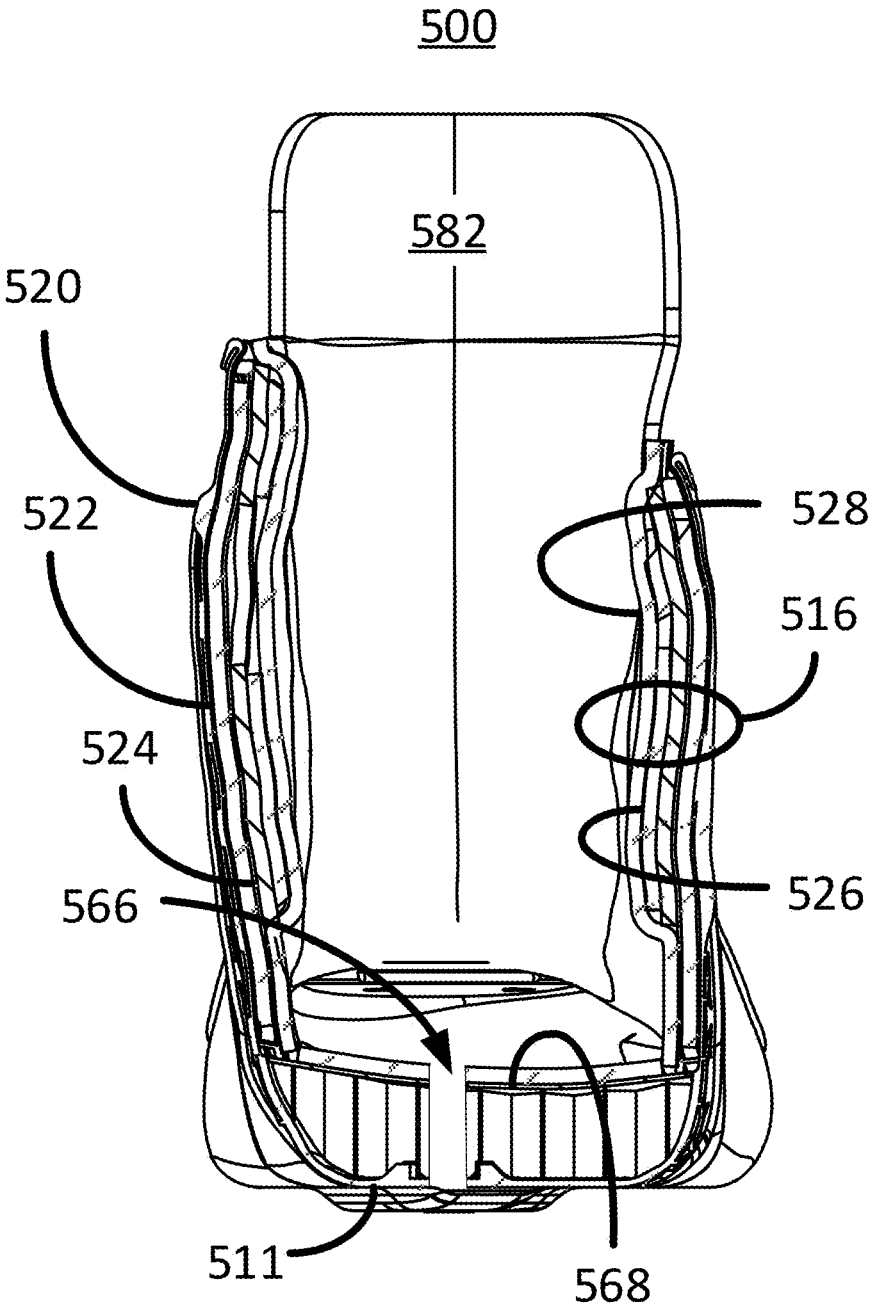

FIGS. 6A-6C are various views of a skate boot assembly consistent with embodiments of the present invention. FIG. 6A is an isometric view of a skate boot assembly 500, which generally shows the boot body 502, the toe box 508, a tendon guard 540 at the heel region 512, the tongue 580 and 582, which covers a tongue gap 514 at the boot front 515. The tongue gap 514 is defined as the space between the lace boarders/edges 518. For example, skate laces (not shown) threaded through the eyelets 525 zigzag across the tongue gap 514 when the boot 500 is secured to a skater's foot. The skate boot assembly 500 comprises a ribbed stiffener 506 on the sidewall 516 of the boot 500. The ribbed stiffener 506 is a ribbed member that extends outwardly from the boot 500, which in this embodiment extends from the boot sole 511 towards the collar 564. The skater's foot is inserted through the foot access port 565 defined by the collar 564 and tongue gap 514 where the skater's leg extends from the boot 500 when being warn. A hex patterned stiffener 504 is a raised stiffener that is bounded in the periphery of the rib stiffener 506. The combination of the hex patterned stiffener 504 and the ribbed stiffener 506 provides stiffening to the sidewall 516, which historically has been accomplished by simply having a thicker sidewall. Alternative shapes, other than the hex pattern and the ribbed stiffener are conceivable. The hex patterned stiffener 504 and the ribbed stiffener 506 do not necessarily have to coexist on the boot 500, rather the boot can just have the ribbed stiffener 506, for example. The use of the hex patterned stiffener 504 in between the ribbed stiffener 506 reduces the amount of composite material otherwise required to construct the boot 500 as well as reducing the weight of the boot 500 compared with a thicker sidewall of the current boots. Likewise with the toe box 508, the toe box hex pattern 510 adds protection with less of a weight penalty than a state-of-the-art thicker toe box.

FIG. 6B is a side view of the skate boot assembly 500 with a cross-sectional cut-line BB extending through the sidewall 516 through the hex patterned stiffener 504 and the ribbed stiffener 506. FIG. 6C is the cross-section of the skate boot assembly 500 along cut-line B-B viewing the heel portion/region 512 of the boot 500. FIG. 6E is a cross-section view of the layers in the sidewall 516 of the skate boot 500 encircled by the oval of FIGS. 6C and 6D. One embodiment of the boot sidewall 516 contemplates the sidewall 516 comprising an outer boot shell 520, an additive manufactured layer 522, an impact absorbing layer 524, a thermo-moldable layer 526 and a foot contact layer 528. The outer boot shell 520 can be a carbon fiber in resin, fiber glass in resin or some other hard shell made of a polymer with or without that addition of a fiber or fabric strengthening composite. The outer boot shell 520 can be a unitary shell, meaning a single piece of material and not two or more parts of a boot shell combined or attached together to make the outer boot shell 520. Optional embodiments contemplate the outer boot shell 520 being assembled from multiple boot shell parts. The additive manufactured layer 522 is defined as a component or physical object that is fabricated by laying down and bonding a large number of successive thin layers of materials can be a three-dimensional (3-D) printed polymer. The additive manufactured layer 522 is a boot form or shell made from a three-dimensional (3D) digital model, which can be a single/unitary boot form or multiple portions of the boot form that serves as a substrate to overlay the outer boot shell 520. In certain embodiments, the additive manufactured boot form/layer 522 is used as a substrate to overlay a resin-soaked carbon fabric or fiberglass fabric thereon. The impact absorbing layer 524 is between the additive manufactured layer 522 and the thermo-moldable layer 526. The impact absorbing layer 524 creates a material mismatch impedance in the layers to absorb and disperse shock from a puck or hockey stick, for example (which is further accomplished by at least one other of the layers). The impact absorbing layer 524 can be a foam, such as a memory foam or some other foam, a pile material layer (such as cotton fibers, wool, polymer, etc.), a void, or a combination of a void, foam and or pile. The thermo-moldable layer 526 is a heat moldable internal shell that can mold to the wearer's foot when heated and retain the custom shape of the wearer's foot upon cooling. The thermo-moldable layer 526 can further serve as a shock dispersion layer that disperses the shock from a hit to the side of the boot 516 via hockey puck or stick. The foot contact layer 528 is a soft/pliable layer configured to interface a wearer's foot. This can be a padded fabric layer, such as a padded cotton or other textile that adds to the comfort of the boot 500 and provides additional impact resistance.

A snap in cover (not shown) that covers an access port 566 in the inner sole region to access the hardware that attaches the blade system (such as, the front and rear multi-degree of freedom arrangements 160 and 170 or the single riser assembly 400, for example) to the boot 500, or more specifically, the boot sole 511. In this embodiment, the boot sole 511 is a honeycomb structure 568 to provide high stiffness to weight.

Figure 6D:
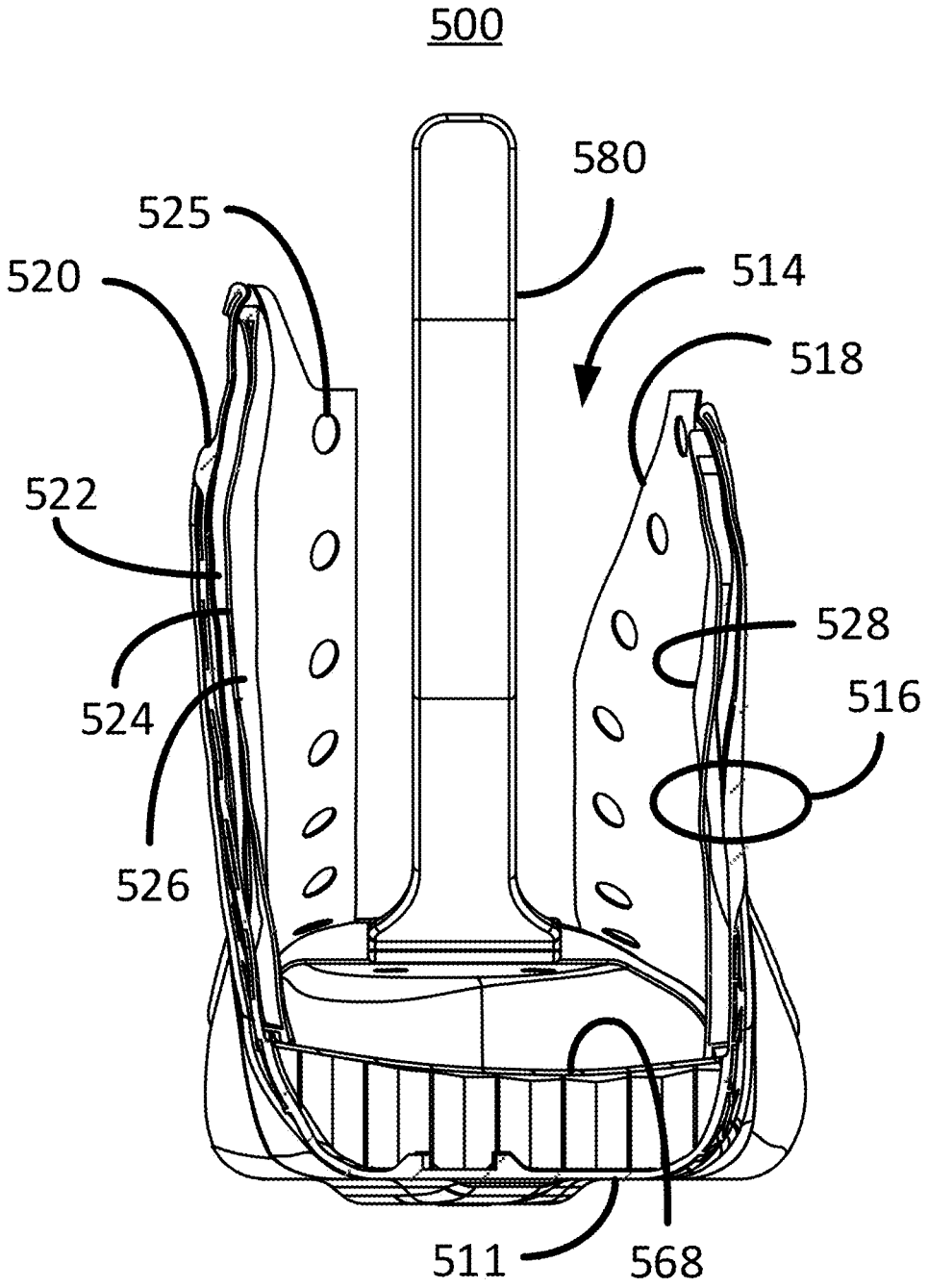
Figure 6E:
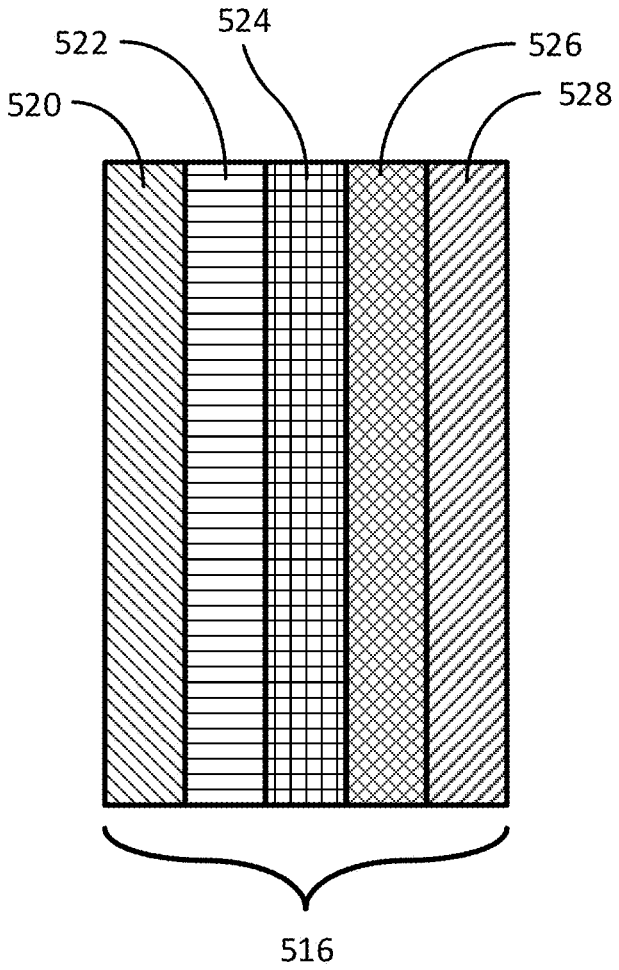
FIG. 6E is a cross-section view of the layers in the sidewall of the skate boot consistent with embodiments of the present invention.

FIG. 6D is a cross-section of the skate boot assembly 500 along cut-line B-B viewing the toe box 508 and tongue gap 514 of the interior of the boot 500. The removable skate tongue 580 is shown in the tongue gap 514, which is defined as the gap between the lace boarders/edges 518, where the eyelets 525 are located. The layers 520, 522, 524, 526 and 528 of the sidewall 516 are shown along with the honeycomb sole structure 568 above the boot sole 511.

Figure 7A:
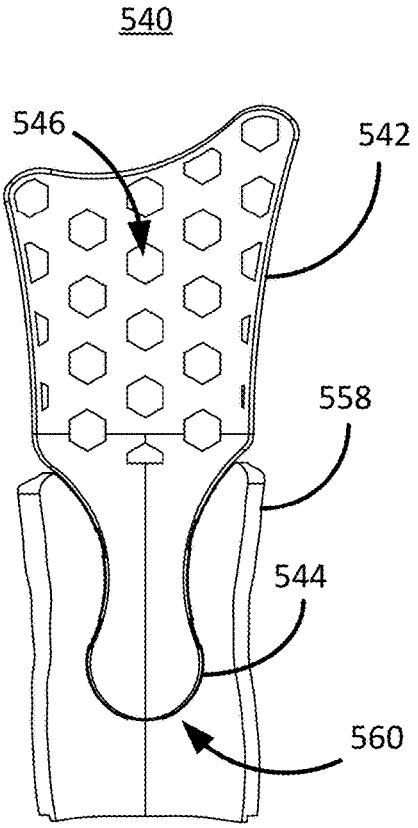
FIGS. 7A-7C are various views of a removable tendon guard assembly consistent with embodiments of the present invention.
Figure 7B:
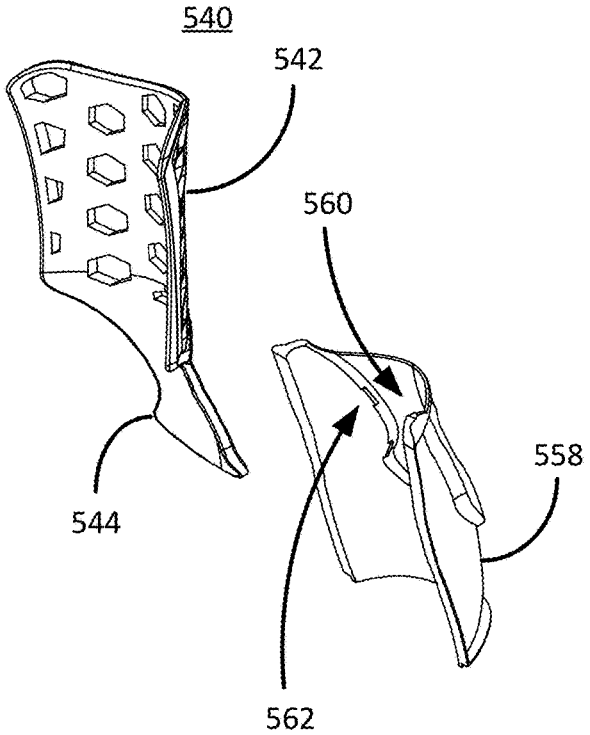
Figure 7C:
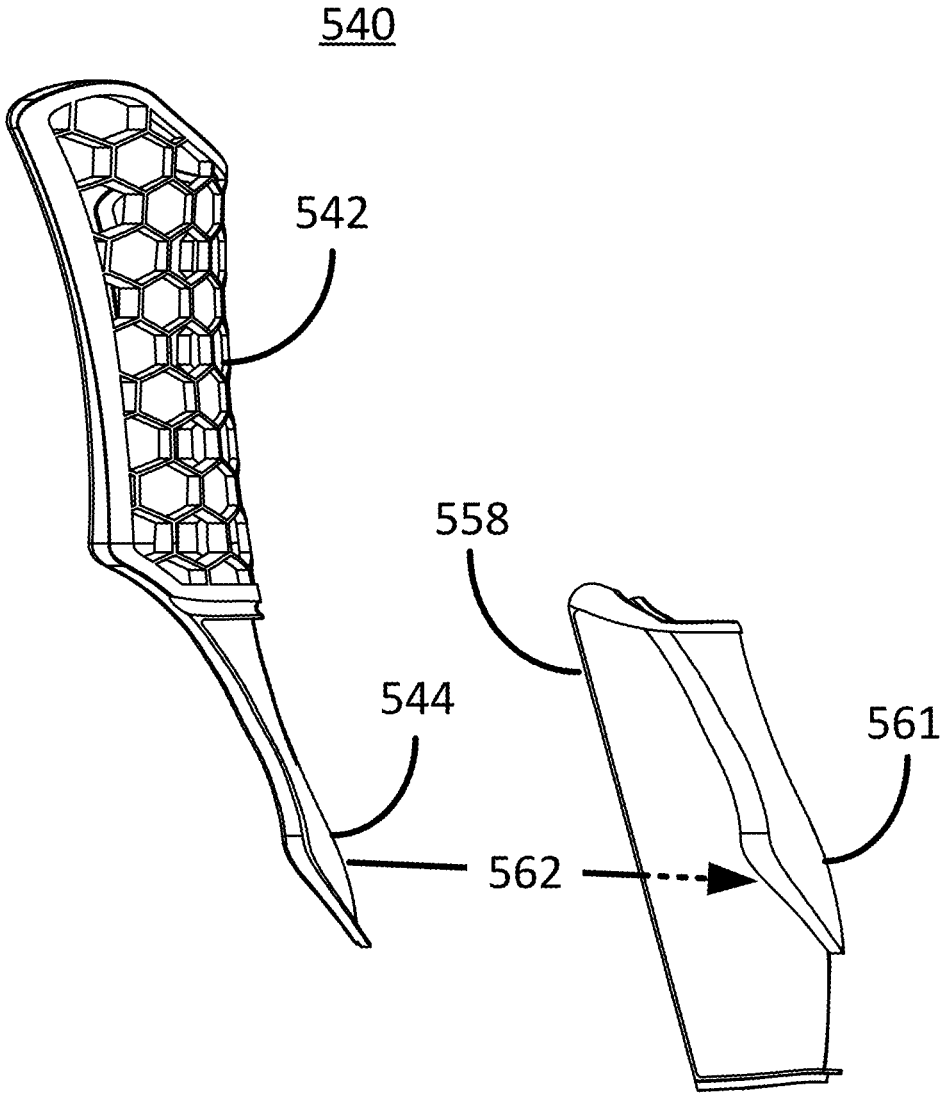

FIGS. 7A-7C are various views of a removable tendon guard assembly consistent with embodiments of the present invention. As shown in FIG. 7A, the tendon guard assembly 540 comprises an independent and removable tendon guard 542 that connects to either the inner part 528 of the boot 500 at the heel end 512 of the boot 500 or a heel insert 558 that is inserted and connected to the inner surface of the boot 500 at the boot's heel portion 512. The tendon guard 540 can be removed and replaced if the tendon guard 540 is damaged or optionally with other shaped tendon guards that are custom or semi-custom to the wearer. In this embodiment, the tendon guard 542 comprises a keyed member 544 that matingly engages a slot 560 in a heel insert 558, the heel insert 558 inserts into the inner surface 528 of the boot's heel portion 512. As shown in FIG. 7B, the keyed member 544 can comprise snaps that connect with snap recesses 562 in the heel insert 558, as shown. The tendon guard 542 can be snapped in place, glued in place, taped in place, etc., as is understood by those skilled in the mechanical arts. FIG. 7C shows a side view of the tendon guard 542 being inserted in the heel insert 558, as shown by the arrow 562. The outer slot imprint 561 of the slot 560 is shown. The heel insert 558 can be bonded or affixed to the inner surface 528 of the heel 112 by way of a number of different techniques known to those skilled in the art.

Figure 8A:
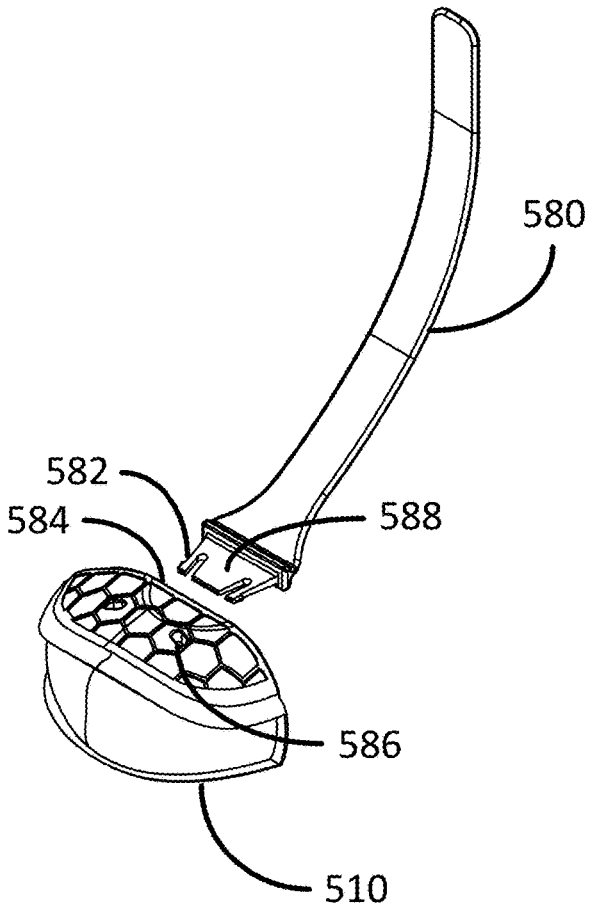
FIGS. 8A and 8B are various views of a removable skate tongue assembly consistent with embodiments of the present invention.
Figure 8B:
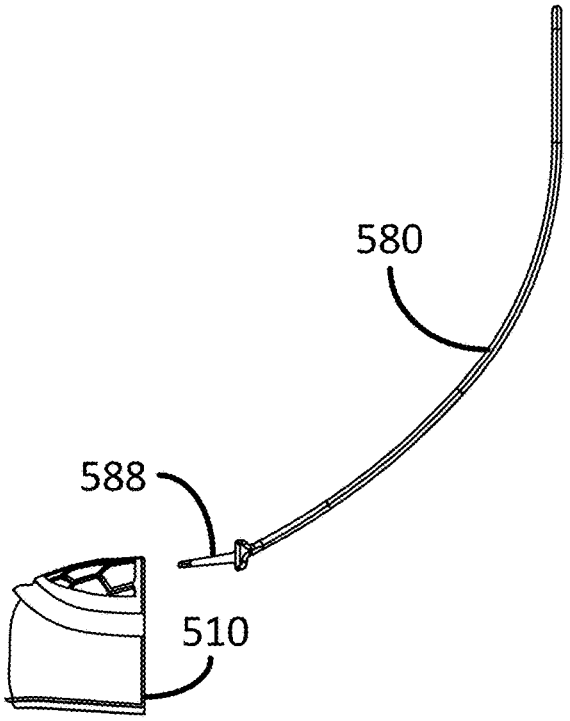

FIGS. 8A and 8B are various views of a removable skate tongue assembly consistent with embodiments of the present invention. As shown in FIG. 8A a removable skate tongue embodiment 580 is positioned in front of the toe box 508 where it can snap into place by mating the double side-by-side snap features 582 at the tongue toe end 588 with receiving snap recesses or slots 586 in the toe box 508. In this embodiment, there is a toe box sleeve 584 that can receive the tongue toe end 588. Other mechanical configurations are envisioned to retain, in a removable way, the tongue 580 to the toe box 508. FIG. 8B is a side view of the removable skate tongue 580 being positioned to snap into the toe box 508.

With the present description in mind, below are some examples of certain embodiments illustratively complementing some of the apparatus embodiments discussed above and presented in the figures to aid the reader. Accordingly, the elements called out below are provided by example to aid in the understanding of the present invention and should not be considered limiting. The reader will appreciate that the below elements and configurations can be interchangeable within the scope and spirit of the present invention. The illustrative embodiments can include elements from the figures.

In that light, certain embodiments of the present invention envision an ice skate boot 500, as shown in FIGS. 6A-6E, envisions a boot 500 that is generally defined by an outer boot shell 520 that includes a boot sole 511, a heel region 512, a toe box 508, and sidewalls 516 between the toe box 508 and the heel region 512. The sidewalls 516 extend from said boot sole 511 to a boot collar 564 and tongue gap 514. Each of the sidewalls 516 generally comprises an impact absorbing layer 524, a thermo-moldable layer 526 and a foot contact layer 528, wherein the foot contact layer 528 configured to interface a human foot. The impact absorbing layer 524 is interposed between said outer boot shell 520 and said thermo-moldable layer 526, said thermo-moldable layer 526 is interposed between said impact absorbing layer 524 and said foot contact layer 528. The thermo-moldable layer 526 and said impact absorbing layer 524 are incorporated in said heel region 512 and extending at least to said toe box 508.

The impact absorbing layer 524 of the ice skate boot 500 is further envisioned being foam.

The impact absorbing layer 524 of the ice skate boot 500 is further envisioned being a void.

The ice skate boot 500 can further comprise an additive manufactured layer 522 between aid outer boot shell 520 and said impact absorbing layer 524. Optionally, the outer boot shell 520 can be bonded to said additive manufactured layer 522. The outer boot shell 520 can be either a carbon fiber and resin composite or fiber glass and resin composite, in some embodiments. In another embodiment, said additive manufactured layer 522 can be a three-dimensional printed polymer.

The outer boot shell 500 of the ice skate boot 500 can be unitary, meaning is it not formed of multiple components connected together but rather a single continuous component.

The ice skate boot 500 further imagines said boot sole 511 comprising a honeycomb structure.

The ice skate boot 500 further imagines said boot sole 511 comprising an access port 566 that extends through the boot sole 511.

The ice skate boot 500 further imagines said impact absorbing layer 524, said thermo-moldable layer 526 and said foot contact layer 528 at least partially extending into said boot sole 511.

Another embodiment of the present invention, as shown in FIGS. 6A-6E, envisions a reinforced ice skate boot 500 generally comprised of an outer boot shell 520 that includes a boot sole 511, a heel region 512, a toe box 508, and sidewalls 516 between the toe box 508 and the heel region 512. The sidewalls 516 can extend from said boot sole 511 to a boot collar 564 and tongue gap 514. Each of said sidewalls 516 comprises an additive manufactured layer 522, an impact absorbing layer 524, a thermo-moldable layer 526 and a foot contact layer 528, wherein the foot contact layer 528 is configured to interface a human foot. The additive manufactured layer 522 is interposed between said outer boot shell 520 and said impact absorbing layer 524. The thermo-moldable layer 526 is interposed between said impact absorbing layer 524 and said foot contact layer 528. The thermo-moldable layer 526 and said impact absorbing layer 524 are incorporated in said heel region 512 and extend at least to said toe box 508.

The outer boot shell 520 of the reinforced ice skate boot 500 can further be a fiber and resin shell.

The impact absorbing layer 524 of the reinforced ice skate boot 500 can further be foam, a void or a combination comprising said void and said foam.

The reinforced ice skate boot 500 further envisions said outer boot shell 520 being a fiber and resin composite bonded to said additive manufactured layer 522.

The reinforced ice skate boot 500 further imagines said additive manufactured layer 522 being a three-dimensional printed polymer.

The reinforced ice skate boot 500 further contemplates said outer boot shell 500 being unitary.

The reinforced ice skate boot 500 further contemplates said boot sole 511 comprising a honeycomb structure.

Yet another embodiment of the present invention, as shown in FIGS. 6A-6E, envisions a multilayer ice skate boot 500 comprising an outer boot shell 520 that includes a boot sole 511, a heel region 512, a toe box 508, and sidewalls 516 between the toe box 508 and the heel region 512. The sidewalls 516 extend from said boot sole 511 to a boot collar 564 and tongue gap 514. Each of said sidewalls 516 comprises an additive manufactured layer 522, an impact absorbing layer 524, a thermo-moldable layer 526 and a foot contact layer 528, wherein the foot contact layer 528 is configured to interface a human foot. The additive manufactured layer 522 is interposed between said outer boot shell 520 and said impact absorbing layer 524. The thermo-moldable layer 526 is interposed between said impact absorbing layer 524 and said foot contact layer 528. The thermo-moldable layer 526 and said impact absorbing layer 524 are incorporated in said heel region 512 and extend at least to said toe box 508. It is to be understood that even though numerous characteristics and advantages of various embodiments of the present invention have been set forth in the foregoing description, together with the details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended embodiments are expressed. For example, the orientation of the elements, and the combination thereof can include other geometries not explicitly shown in the embodiments above while maintaining essentially the same functionality without departing from the scope and spirit of the present invention. Further, the term "one" is synonymous with "a", which may be a first of a plurality.

It will be clear that the present invention is well adapted to attain the ends and advantages mentioned as well as those inherent therein. While presently preferred embodiments have been described for purposes of this disclosure, numerous changes may be made which readily suggest themselves to those skilled in the art and which are encompassed in the spirit of the invention disclosed.

What is claimed is:

1. An ice skate boot comprising:

an outer boot shell that includes a boot sole, a heel region, a toe box, and sidewalls between the toe box and the heel region, the sidewalls extend from the boot sole to a boot collar and tongue gap;

the sidewalls each comprising an impact absorbing layer, a thermo-moldable layer and a foot contact layer, the foot contact layer configured to interface a human foot;

the impact absorbing layer interposed between the outer boot shell and the thermo-moldable layer, the thermo-moldable layer interposed between the impact absorbing layer and the foot contact layer, the thermo-moldable layer and the impact absorbing layer incorporated in the heel region and extending at least to the toe box.

2. The ice skate boot of claim 1, wherein the impact absorbing layer is foam.

3. The ice skate boot of claim 1, wherein the impact absorbing layer is a void.

4. The ice skate boot of claim 1 further comprising an additive manufactured layer between aid outer boot shell and the impact absorbing layer.

5. The ice skate boot of claim 4, wherein the outer boot shell is bonded to the additive manufactured layer.

6. The ice skate boot of claim 4, wherein the outer boot shell is either a carbon fiber and resin composite or fiber glass and resin composite.

7. The ice skate boot of claim 4, wherein the additive manufactured layer is three-dimensional printed polymer.

8. The ice skate boot of claim 1, wherein the outer boot shell is unitary.

9. The ice skate boot of claim 1, wherein the boot sole comprises a honeycomb structure.

10. The ice skate boot of claim 1, wherein the boot sole comprises an access port 566 that extends through the boot sole.

11. The ice skate boot of claim 1, wherein the impact absorbing layer, the thermo-moldable layer and the foot contact layer at least partially extend into the boot sole.

12. A reinforced ice skate boot comprising:

an outer boot shell that includes a boot sole, a heel region, a toe box, and sidewalls between the toe box and the heel region, the sidewalls extend from the boot sole to a boot collar and tongue gap;

each of the sidewalls comprising an additive manufactured layer, an impact absorbing layer, a thermo-moldable layer and a foot contact layer, wherein the foot contact layer is configured to interface a human foot;

the additive manufactured layer interposed between the outer boot shell and the impact absorbing layer, the thermo-moldable layer interposed between the impact absorbing layer and the foot contact layer, the thermo-moldable layer and the impact absorbing layer incorporated in the heel region and extending at least to the toe box.

13. The reinforced ice skate boot of claim 12, wherein the outer boot shell is a fiber and resin shell.

14. The reinforced ice skate boot of claim 12, wherein the impact absorbing layer is foam, is a void or a combination comprising the void and the foam.

15. The reinforced ice skate boot of claim 12, wherein the outer boot shell is a fiber and resin composite bonded to the additive manufactured layer.

16. The reinforced ice skate boot of claim 12, wherein the additive manufactured layer is a three-dimensional printed polymer.

17. The reinforced ice skate boot of claim 12, wherein the outer boot shell is unitary.

18. The reinforced ice skate boot of claim 12, wherein the boot sole comprises a honeycomb structure.

19. A multilayer ice skate boot comprising:

an outer boot shell that includes a boot sole, a heel region, a toe box, and sidewalls between the toe box and the heel region, the sidewalls extend from the boot sole to a boot collar and tongue gap;

each of the sidewalls comprising an additive manufactured layer, an impact absorbing layer, a thermo-moldable layer and a foot contact layer, wherein the foot contact layer is configured to interface a human foot, the additive manufactured layer interposed between the outer boot shell and the impact absorbing layer, and the thermo-moldable layer interposed between the impact absorbing layer and the foot contact layer.

20. The multilayer ice skate boot of claim 19, wherein the thermo-moldable layer and the impact absorbing layer are incorporated in the heel region and extend at least to the toe box.

* * * * *